US006085687A

United States Patent [19]

Chester

[11] Patent Number: 6,085,687

[45] Date of Patent: Jul. 11, 2000

[54] FLAG MOUNT FOR VEHICLE LUGGAGE RACK

[76] Inventor: Morgan Chester, 21313 Hwy. 80, West, Statesboro, Ga. 30458

[21] Appl. No.: 08/968,123

[22] Filed: Nov. 12, 1997

Related U.S. Application Data

[63] Continuation of application No. 08/777,991, Jan. 2, 1997, abandoned.

[51] Int. Cl.[7] ..... G09F 17/00

[52] U.S. Cl. ..... 116/173; 116/28 R

[58] Field of Search ..... 40/592; 116/28 R, 116/173, 174, 175; 224/319, 324, 512, 555, 558; 248/534, 535, 539

[56] References Cited

U.S. PATENT DOCUMENTS

| | | | |
|---|---|---|---|
| 1,279,669 | 9/1918 | Deming | 248/541 |
| 1,524,967 | 2/1925 | Dahl | 248/541 |
| 1,535,396 | 4/1925 | Buehler | 248/541 |
| 2,680,588 | 6/1954 | Wright | 116/28 R |
| 2,782,973 | 2/1957 | Lang | 224/324 X |
| 2,988,253 | 6/1961 | Menghi | 224/324 X |
| 3,136,289 | 6/1964 | Johnson | 116/28 R |
| 3,438,651 | 4/1969 | Hertoghe et al. | 116/173 |
| 3,493,203 | 2/1970 | Gulano | 116/174 X |
| 3,643,902 | 2/1972 | Gulano | 248/539 |
| 4,002,138 | 1/1977 | Dobala | 116/28 R |
| 4,650,147 | 3/1987 | Griffin | 248/539 |
| 5,233,938 | 8/1993 | Lalo | 116/173 |
| 5,316,192 | 5/1994 | Ng | 224/324 |
| 5,431,364 | 7/1995 | Etter | 248/514 |
| 5,524,857 | 6/1996 | Eisenberg et al. | 248/535 |
| 5,549,940 | 8/1996 | Noone | 428/31 |

*Primary Examiner*—Hezron E. Williams
*Assistant Examiner*—Willie Morris Worth
*Attorney, Agent, or Firm*—Laurence R. Brown

[57] ABSTRACT

An accessory is provided for mounting flags, typically favorite team pennants or insignia, on the rooftops of vehicles provided upwardly extending bars such as luggage racks by means of a clamping mechanism that orients a flagstaff vertically a predetermined distance above the rooftop, and thus provide high visibility without interfering with driver vision or damaging the exterior surface of the automobile. The flag vertically extends at a height that serves as a car finding signal in crowded stadium parking lots.

9 Claims, 2 Drawing Sheets

FLAG MOUNT FOR VEHICLE LUGGAGE RACK

This application is a continuation of application Ser. No. 08/777,991, filed Jan. 2, 1997, now abandoned.

TECHNICAL FIELD

This invention relates to accessories for displaying flags, and more particularly it relates to accessories for mounting flags for visible display on vehicles.

BACKGROUND ART

Flying flags from automobiles has been popular for many years. In particular it is currently popular to carry on an automobile highly visible flags or pennants for sports teams, colleges and the like. Automobiles decorated with a sports theme are exemplified by U.S. Pat. No. 5,549,940, Aug. 27, 1996, R. P. Noone for Stock Motor Vehicle Outfitted with a Sports Theme Kit. It is particularly popular to display flags indicating team loyalty at tail gate parties at stadium parking lots preceding and following ball games.

Prior art flag holders for mounting flags on the front hood area of automobiles are typified by U.S. Pat. No. 1,279,669, Sep. 24, 1918, W. L. Deming for Flagstaff Holder; U.S. Pat. No. 1,524,967, Feb. 3, 1925, G. Dahl for Adjustable Double Clamp; and U.S. Pat. No. 1,535,396, Apr. 28, 1925, C. Buehler for Flag Holder for Automobiles. These flag holders are not satisfactory, since they constitute a safety hazard in interfering with a drivers view of the road when driving. Furthermore, with front hood type mounts, the flags are not visible to trailing drivers, and thus fail to provide a wide range of visibility either for standing or driven automobiles.

Also flag holders are mounted between a closed car window and door frame in U.S. Pat. No. 5,233,938, Aug. 10, 1993, A. Lalo for Vehicle Flag System. These flag holders interfere with the opening of windows and may scratch or damage the car finish or window glass when used, and may be a safety hazard obscuring the driver's view out of a window.

Thus, it is an objective of this invention to provide improved flag holders for automobiles or other transportation vehicles such as motorhomes or boats that do not introduce safety hazards and which prominently display the flags in a highly visible position both when the automobile is parked and driven.

DISCLOSURE OF THE INVENTION

This invention therefore provides a flag mounting accessory for visibly mounting a flag on the rooftop of an automobile. In a preferred embodiment of the invention, the accessory provides an adjustable mount that clamps on to a crossbar of a luggage rack affixed to the automobile rooftop. That crossbar member is spaced above the rooftop and provides a foundation to which the flag mounting accessory may be attached, either semi-permanently or temporarily without damage to the automobile finish, for prominently displaying a desired flag either while parking or driving the automobile. For example, the flag flown from the top of the automobile provides an excellent guide viewable across a stadium parking lot for locating a particular parking space.

A clamp-on bracket member may be positioned as desired on the crossbar member and is readily installed and removed. The accompanying flag and flagstaff array is socketed or otherwise removably mounted on the clamp-on bracket member and positioned for disposing the flagstaff vertically to fly its attached flag in a highly visible position above the automobile rooftop.

Other features and advantages of the invention will be found throughout the following specification, drawing and claims.

BRIEF DESCRIPTION OF THE DRAWINGS

In the accompanying drawings, wherein like reference characters throughout the several views indicate like features to facilitate comparison.

THE PREFERRED EMBODIMENTS

Figure 2:
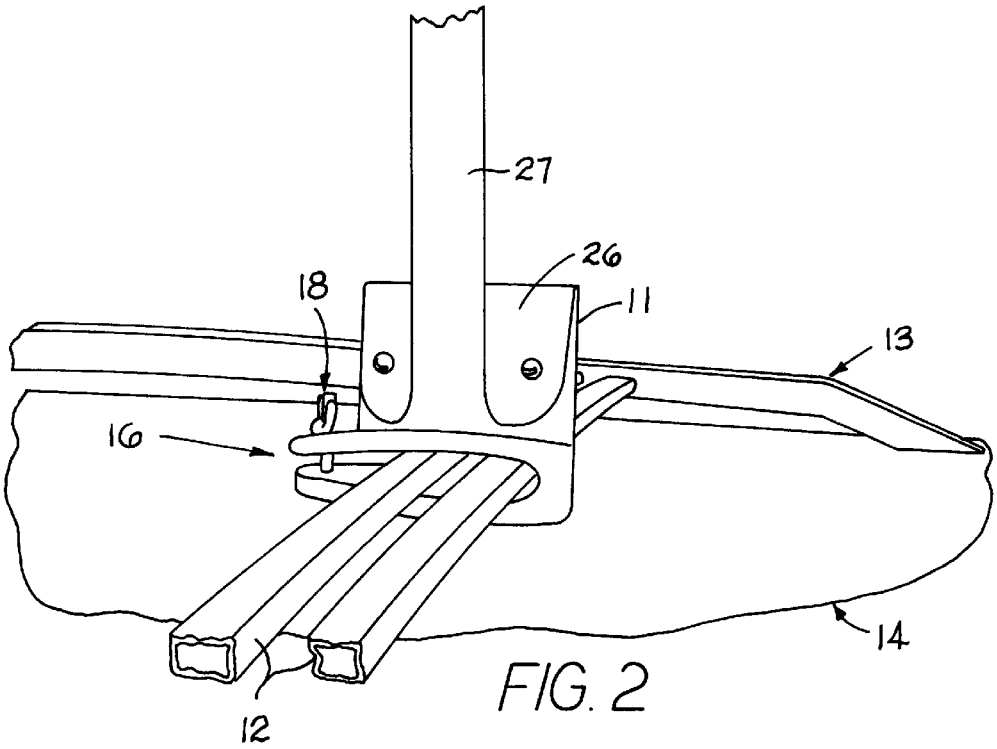
FIG. 2 is a broken away fragmentary perspective view looking downwardly from one side of an automobile at the flag mounting accessory clamped in place upon a crossbar of an automobile top luggage rack.
Figure 1:
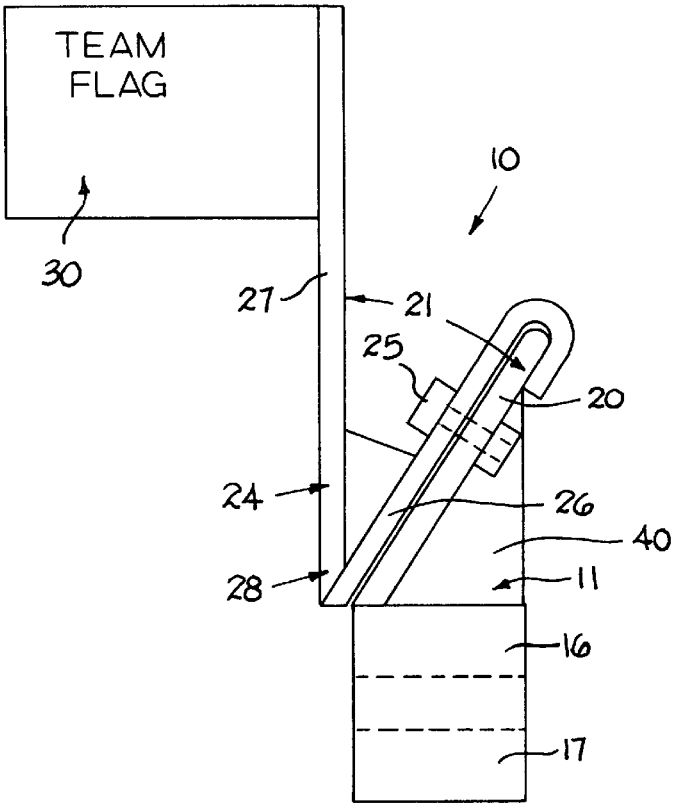
FIG. 1 is an end view sketch of the accessory for mounting flags provided by this invention for mounting on the rooftops of automobiles for prominently visibly displaying a flag.

As may be seen by reference to FIGS. 1 and 2, this invention provides an accessory 10 with a clamp-on bracket member 11 for mounting the accessory on the crossbar 12 of a luggage rack 13 mounted transversely across the rooftop 14 of an automobile (not shown). This bracket member 11 has extending therefrom two substantially parallel spaced clamping members 16, 17 dimensioned to straddle and hug the crossbar 12. Bolt 18 has its nut tightened to resiliently bend the ends of the spaced clamping members 16, 17 together to frictionally clamp the bracket member 11 securely in place with the clamping members 16, 17 disposed substantially parallel to the rooftop 14. Thus, the clamp-on bracket member 11 may be made of a semi-rigid plastic material providing resilience to the clamping members 16, 17, which may have treated clamping surfaces to improve frictional contact.

The mounting plate 20, extending generally vertically from the crossbar 12 at an acute angle 21 removably receives a flag mounting array 24 thereupon by means of bolt 25. Thus, the corresponding contiguously mating mounting plate 26 provides a stable mount for vertically orienting the flagstaff 27. The flagstaff 27 may be removably socketed in the socket 28, or integrally attached to a unitary flag mounting array 24. As later shown the flag 30 may be removably attached to the flagstaff 27. The flag mounting array 24 may also be made of a suitable rigid plastic material.

Figure 4:
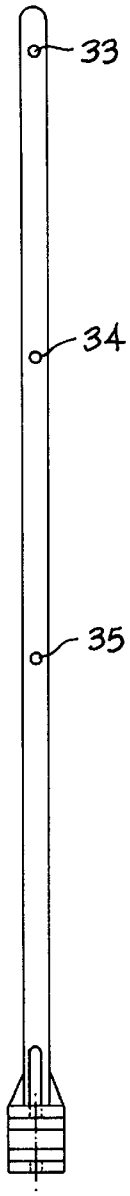
FIG. 4 is a profile end view of the accessory of FIG. 3.
Figure 3:
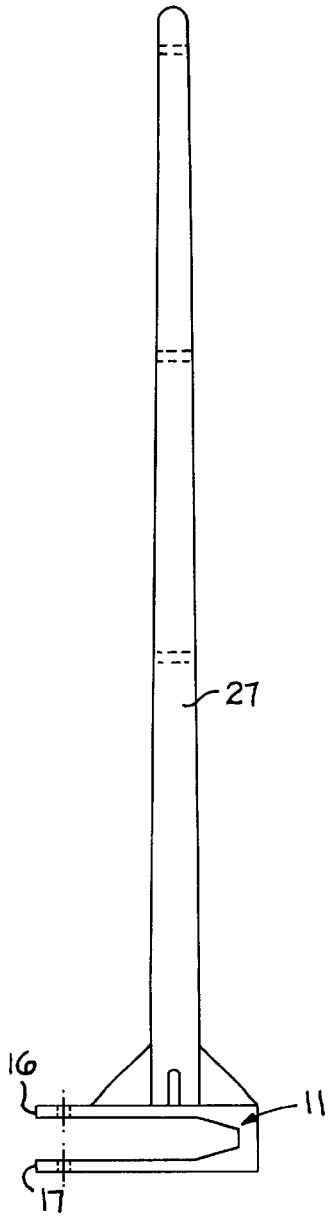
FIG. 3 is a profile side view of the accessory, without accompanying flag, looking into a set of parallel clamping arms for securing the accessory to a crossbar mounted on an automobile rooftop.

As seen from FIGS. 3 and 4, the flagstaff 27 may be integrally or removably affixed to the clamp-on bracket member 11, and the flag may be mounted from the three holes 33, 34, 35 through the flagstaff pole 27. Typically the height of the array is about twenty inches, and the flagstaff is tapered with an upper diameter of about half an inch and a lower diameter of one inch. The span of the clamping members 16, 17 is typically about four inches.

Figure 6:
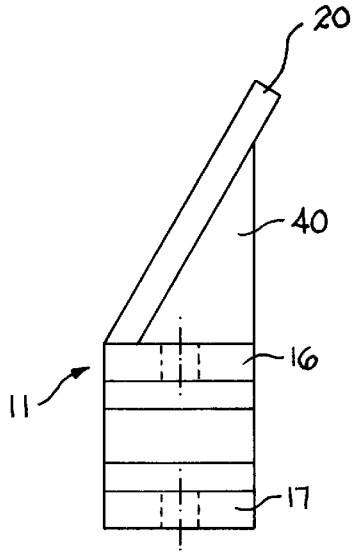
FIG. 6 is an enlarged end view looking into the left side of the FIG. 5 clamp-on bracket member.
Figure 5:
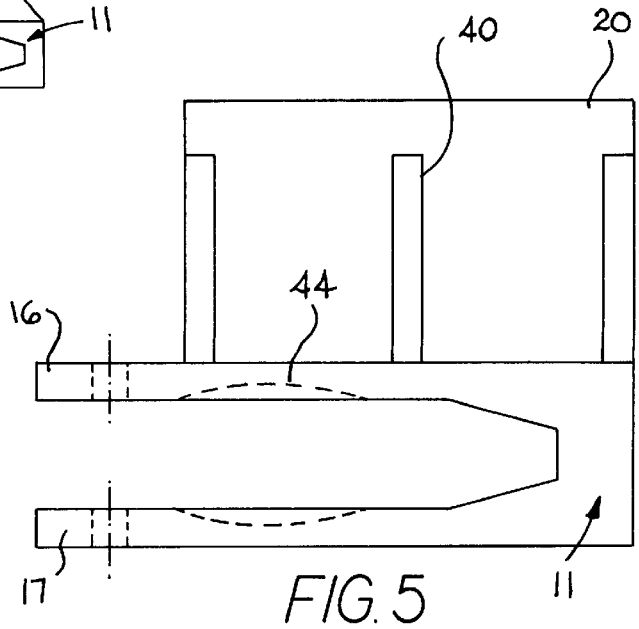
FIG. 5 is an enlarged side view of a clamp-on bracket member for attachment of the accessory to a luggage rack crossbar.

The enlarged views of the clamp-on bracket member as shown in FIGS. 5 and 6 set forth in more detail a preferred embodiment. The mounting plate 20 has three fillets 40 spaced thereacross. The clamping members 16, 17 are shown for attachment to a substantially rectangular crossbar 12 shape, but as shown by dotted lines 44, may be contoured, for example to mount upon cylindrical crossbars.

In view of the advancement of the art provided by the herein disclosed accessory for mounting flags on the rooftops of automobiles, those features of novelty are defined with particularity in the following claims to define the spirit and the essence of the invention.

What is claimed is:

1. An accessory system for mounting flags on automobiles, comprising in combination:

a clamp-on bracket member attachable to said luggage rack crossbar at a position not interfering with driver vision and visible to trailing vehicle drivers, said bracket member having extending therefrom two substantially parallel spaced clamping members dimensioned to straddle and hug said crossbar, fastening means for moving the two spaced clamping members together for removably frictionally clamping the bracket member securely on the crossbar with the clamping members disposed substantially parallel with the automobile rooftop, mounting means for extending a bracket member mounting surface generally vertically from said crossbar and for removably receiving a flag mounting array thereupon, and a flag mounting array comprising a flag, a flagstaff and flag mounting array mounting surface that contiguously removably mates with the bracket member mounting surface to position the flagstaff vertically with the flag visibly displayed above the automobile rooftop to be viewed from trailing automobiles but not interfering with driver vision from said automobile.

2. The accessory system of claim 1 wherein said flag mounting array further comprises a removable socket assembly for removably receiving said flagstaff, and means for affixing the removable socket assembly onto said bracket member.

3. The accessory system of claim 1 wherein the clamping members are shaped to clamp onto a cylindrical crossbar.

4. The accessory system of claim 1 wherein the clamping members are shaped to clamp onto a substantially rectangular crossbar of predetermined cross sectional dimensions.

5. The accessory system of claim 1 wherein the clamping members are of an elastically deformable material which frictionally grasps the crossbar to retain the accessory secured thereto in reaction to said fastening member.

6. The accessory system of claim 5 wherein the clamping members are of a semi-rigid plastic material having treated clamping surfaces to improve frictional contact.

7. The accessory system of claim 1 wherein the mounting array flagstaff mounting surface is disposed at an acute angle from the flagstaff.

8. A flag mounting accessory for flying a flag on a vehicle with a luggage rack having cross bars in a position on a selected crossbar viewable from a trailing vehicle without interfering with driver vision for extending the flag upwardly from the vehicle, comprising in combination, a clamp-on bracket with a clamping device for holding the bracket stably upon the selected luggage rack cross bar, said bracket comprising means for mounting the bracket on the crossbar with a mounting plate extending upwardly from the crossbar at an acute angle from vertical and a mating flag mounting assembly removably having means for fastening said, mating flag mounting assembly in place on the mounting plate by way of a contiguously mating mounting plate, and a flag-flagstaff member having means for affixing said flag-flagstaff member removably to the mating mounting plate for positioning the flag vertically at a predetermined distance above the cross bar.

9. A flag mounting accessory system for visibly mounting a flag on a a rooftop of an automobile in a position viewable from a trailing vehicle but not interfering with driver vision, comprising in combination, an automobile rooftop luggage rack for disposing crossbars on the rooftop, a crossbar member affixed to said automobile rooftop luggage rack, a clamp-on bracket member clamped at a predetermined position on the crossbar member, and a flag and flagstaff array viewable from a trailing vehicle that does not interfere with driver's vision removably mounted on the clamp-on bracket member and positioned with the flagstaff vertically extended for flying its flag in a highly visible position a predetermined distance above the automobile rooftop.

* * * * *